United States Patent [19]

Dorfman et al.

[11] Patent Number: 4,923,095

[45] Date of Patent: May 8, 1990

[54] APPARATUS AND METHOD FOR GENERATING PRESSURES FOR A DISPOSABLE CONTAINER

[75] Inventors: Jan L. Dorfman, Littleton; Larry M. Dugan, Boulder; David C. Young, Westminster; Mark A. Willcoxen, Lakewood, all of Colo.

[73] Assignee: Adolph Coors Company, Golden, Colo.

[21] Appl. No.: 266,515

[22] Filed: Nov. 3, 1988

Related U.S. Application Data

[63] Continuation-in-part of Ser. No. 34,900, Apr. 6, 1987, abandoned.

[51] Int. Cl.[5] ..... B67D 5/42

[52] U.S. Cl. ..... 222/386.5; 222/389; 222/394

[58] Field of Search ..... 222/386.5, 399, 394, 222/386, 387, 389; 60/673, 721, 649; 169/83, 85

[56] References Cited

U.S. PATENT DOCUMENTS

| | | | |
|---|---|---|---|
| 2,932,385 | 4/1960 | Bollmeier et al. | 206/219 |
| 3,096,000 | 7/1963 | Staley | 222/386.5 X |
| 3,128,019 | 4/1964 | Mills | 222/399 X |
| 3,445,043 | 5/1969 | Bull | 222/386.5 |
| 3,718,236 | 2/1973 | Reyner et al. | 222/386.5 |
| 4,032,047 | 6/1977 | Wilson | 222/183 |
| 4,360,131 | 11/1982 | Reyner | 222/399 X |
| 4,373,341 | 2/1983 | Mahaffy et al. | 222/399 X |
| 4,376,500 | 3/1983 | Banks et al. | 222/399 X |
| 4,478,044 | 10/1984 | Magid | 222/399 X |
| 4,491,250 | 1/1985 | Liebermann | 222/386.5 |
| 4,513,884 | 4/1985 | Magid | 222/386.5 X |
| 4,679,706 | 7/1987 | Magid et al. | 222/399 X |

*Primary Examiner*—Joseph J. Rolla
*Assistant Examiner*—David H. Bollinger
*Attorney, Agent, or Firm*—Klaas & Law

[57] ABSTRACT

An expandable pouch for applying a pressure to a material to be dispensed from a container wherein two sheets of a fluid impervious material are permanently joined together at their edges and divided into a plurality of compartments by semi-permanent peelable strips. One of the compartments is divided into sub-compartments with fluid communication being provided between two sub-compartments. One of a two component chemical gas generating system is located in each of the two sub-compartments so that when the pouch is inverted, the chemicals combine to start generating gas to force open the peelable strips.

27 Claims, 4 Drawing Sheets

APPARATUS AND METHOD FOR GENERATING PRESSURES FOR A DISPOSABLE CONTAINER

This application is a Continuation-In-Part of U.S. Pat. application Ser. No. 034,900, filed April 6, 1987. now abandoned.

FIELD OF THE INVENTION

This invention relates generally to a self-generating pressure applying means, such as an expandable pouch which is adapted to be positioned in a container having a quantity of material contained therein so as to provide pressure on the material so that it may be readily dispensed from the container and in particular to a self-generating pressure applying means which is particularly suited for dispensing a fluid from a disposable container.

BACKGROUND OF THE INVENTION

It has been known for many years to dispense material from a container wherein a self-generating pressure applying means is contained within the container so as to apply a pressure on the material contained within the container so that the material may be readily dispensed therefrom through suitable dispensing means. Two major requirements for such use is that the self-generating pressure applying means functions to apply a pressure within desired ranges on the material within the container as portions of the material are dispensed therefrom and to get substantially all of the material out of the container. While these requirements have been met in many instances, the size and shape of some containers in association with the materials container therein have provided problems in meeting these requirements.

BRIEF DESCRIPTION OF THE INVENTION

This invention provides a new, improved self-generating pressure applying means, such as an expandable pouch means for applying pressure to a fluid in a container, which is particularly designed and constructed so that it cooperates with the container in which it is contained to apply pressure to the material in the container to ensure that substantially all of the material contained within the container is dispensed therefrom and maintains the pressure within the container within a desired minimum range of pressures during the dispensing operation. The expandable pouch means of this invention is particularly useful wherever it is undesirable to add additional $CO_2$ to the material in the container and where it is desirable to maintain the pressure on the material in the container within a narrow range of high and low pressures during the entire dispensing operation. The invention also provides new systems for obtaining the initial contact between the two reactive components of a two component chemical gas generating system to commence producing the expanding gas.

In one embodiment of the invention, the self-generating pressure applying means comprises an expandable pouch means comprising two relatively flat sheets of a gas and liquid impermeable plastic material in superposed relationship and having a octagonal shape having a length greater than its width and with the edge portions thereof joined by permanent sealing means. The container comprises a blown hollow integral plastic body having generally hemispherical top and bottom portions, an annular cylindrical central portion and has a longitudinal axis. The expandable pouch means is located within the container so that as the expandable pouch means expands, as described below, it applies pressure to the material in the container means which in the preferred embodiment is a liquid, such as a beverage such as beer. The expandable pouch means is divided into a plurality of compartments of different sizes by lengthwise extending strips of semi-permanent, peelable sealing means for temporarily holding superposed portions of the two relatively flat sheets together. The lengthwise extending strips of semi-permanent, peelable sealing means cooperate with the permanently sealed edge portion so that each of the plurality of compartments are completely enclosed. The expandable pouch means is inserted into the container means so that the lengthwise extending strips are, as much as possible, generally parallel to the longitudinal axis of the container and will move more closely to such relationship as liquid is dispensed from the container. One relatively large compartment in the expandable pouch means is divided into a first and a second relatively small sub-compartment and a third relatively large sub-compartment. A first reactive component of a two component gas generating system is in the first sub-compartment and a small quantity of the second reactive component is in the second sub-compartment. A large quantity of the second reactive component is in the third subcompartment. Each of the other compartments thereof contains a supply of the first reactive component. Just prior to being inserted into the container, an outside force is applied to the first sub-compartment to rupture the peelable sealing means between it and the second sub-compartment so that the first reactive component therein will react with the second reactive component in the second sub-compartment to start generating gas. When the pressure of the gas in the combined first and second sub-compartments is great enough the peelable sealing means between the combined first and second sub-compartments and the third sub-compartment is ruptured so that the reaction can be continued. As fluid is dispensed from the container, the one compartment continues to expand and as it expands, it applies a force on the strip of semipermanent, peelable sealing means between the one compartment and the next adjacent other compartment until such strip is ruptured. The first reactive component of the gas generating system in the next adjacent other compartment reacts with the other reactive components in the one compartment to continue the generation of gas in the combined one compartment and next adjacent other compartment. The expansion of the expandable pouch means continues until substantially all of the fluid has been dispensed from the container means. As successive other compartments are expanded, the expanded portion of the expandable pouch means will take a shape generally corresponding to the shape of the container means. When all the material in the container has been dispensed, puncture means (not described in this application) are then actuated to let the gas pressure escape from the expandable pouch means and the container so that they may be safely placed in the trash.

In the preferred embodiment of the invention, the first sub-compartment is completely enclosed by a lengthwise extending strip of semi-permanent, peelable sealing means and portions of the permanently sealed edge portions and a quantity of the first reactive component in liquid form is contained therein. A quantity of the second reactive component in liquid form and in an amount sufficient for the entire expansion of the expandable pouch means is located in the third sub-compartment. The expandable pouch means are inserted into the container after the container has received the desired quantity of material and the longitudinal axis thereof extends generally in a vertical direction so that the lengthwise extending strips of semi-permanent, peelable sealing means have a top end and a bottom end. The lengthwise extending strip of semi-permanent sealing means between the third sub-compartment and the second sub-compartment has two openings formed therein closer to the top end thereof to provide fluid communication between the third sub-compartment and the second sub-compartment. Prior to inserting the expandable pouch means into the container and while holding the expandable pouch in a vertical position with the openings at the top end, the lengthwise extending strip of semi-permanent, sealing means between the first and second sub-compartments is ruptured so as to combine the first and second sub-compartments into one sub-compartment having the first reactive component located therein. The expandable pouch is then inserted into the container which is then sealed with a suitable dispensing means. After this, the container is inverted so that the first reactive component in the combined first and second sub-compartments and the second reactive component in the third sub-compartment will flow toward the openings between the third sub-compartment and the combined first and second sub-compartments so that the two reactive components will start to react and generate gas. The generation of gas will continue until the first, second and third sub-compartments have been combined to form one relatively large compartment which is expanded an amount sufficient to apply the desired pressure on the material in the container. Thereafter, the other compartments expand as described above.

In another embodiment, the lengthwise extending strip of semi-permanent sealing means between the first and second sub-compartments is eliminated and the expandable pouch is maintained in a vertical position until it has been inserted into the container and the container is sealed. Thereafter, when the container is inverted, the two reactive components will be combined as described above.

BRIEF DESCRIPTION OF THE DRAWINGS

The presently preferred embodiment and other illustrative embodiments of the invention are shown in the accompanying drawings in which.

DETAILED DESCRIPTION OF THE INVENTION

Figure 1:
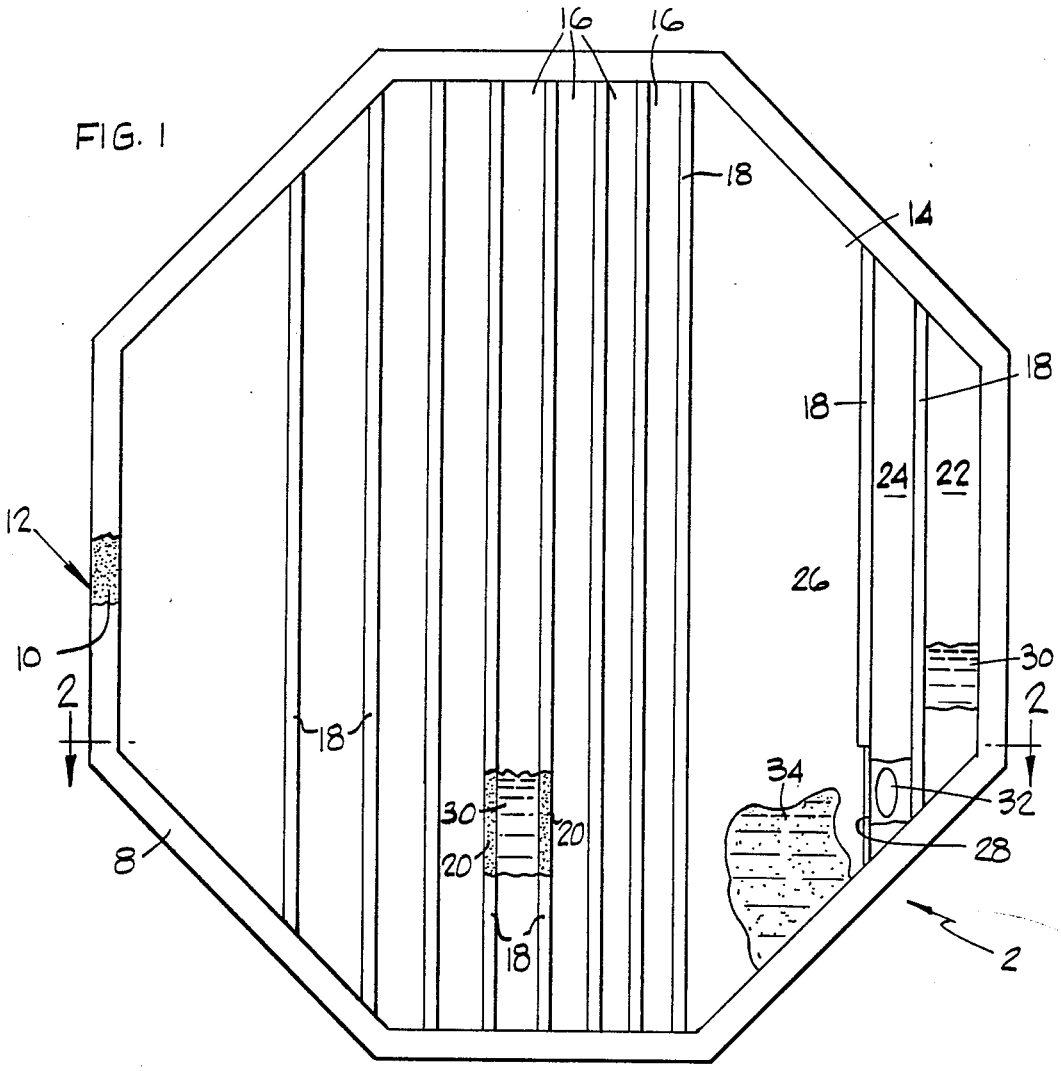
FIG. 1 is a front elevational view with portions broken away illustrating one embodiment of an expandable pouch means and the components of a gas generating system.
Figure 2:
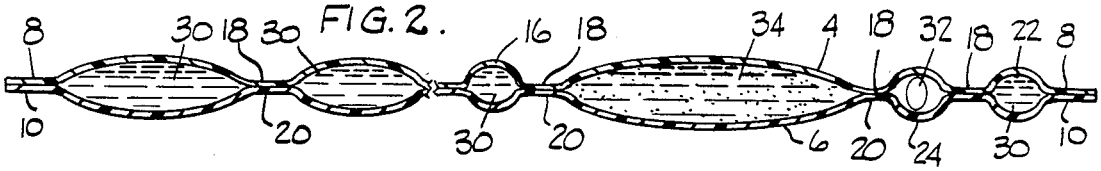
FIG. 2 is a cross-sectional view taken on the line 2—2 of FIG. 1.
Figure 3:
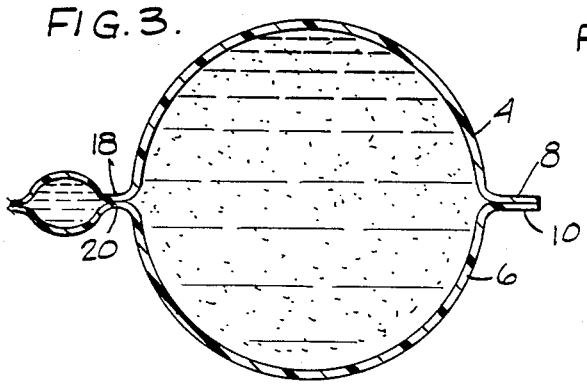
FIG. 3 is a cross-sectional view of a partially expanded expandable pouch means.

An expandable pouch means 2 of the presently preferred embodiment for applying pressure to material in a container, as described below, is illustrated in FIGS. 1–3 and comprises two relatively flat sheets 4 and 6 of a flexible plastic material in superposed relationship and made from a gas and liquid impermeable material such as a composite material of an outside layer of a polyester with an inside coating of PVDC, a layer of polyethylene and a layer of an ionomer resin, such as that marketed by Dupont under the trade designation SURLYN®. Each of the flat sheets 4 and 6 is octagonal in shape having a length greater than its width and with peripheral edge portions 8 and 10 permanently joined together by a permanent sealing means 12 formed by heat sealing at a temperature of about 300° F. for about 0.5 second. The expandable pouch 2 is formed into a first compartment 14 and a plurality of other compartments 16 by a plurality of lengthwise extending strips 18 which join together opposed portions of the flat sheets 4 and 6 using a semi-permanent peelable sealing means 20 formed by heat sealing at a temperature of about 250° F. for about 0.5 second. The lengthwise extending strips 18 cooperate with the permanently sealed edge portions 8 and 10 so that each of the compartments 14 and 16 are completely enclosed. The compartment 14 is divided into a first sub-compartment 22, a second sub-compartment 24 and a third sub-compartment 26. If the flat sheets 4 and 6 are formed from different plastic materials, the temperature and time would be adjusted as required to obtain the desired type of seal. Also, if desirable, a suitable adhesive could be used to obtain the desired results.

The normal operation of an expandable pouch means 2 uses some delaying system so that the chemical reaction can be started and still allow for sufficient time for the expandable pouch means 2 to be inserted into the container and suitable sealing and dispensing means applied to the container. The first sub-compartment 22 is formed by a lengthwise extending strip 18, as described above, extending parallel to the next adjacent permanent lengthwise extending sealed edge portions 8 and 10. The second and third sub-compartments 24 and 26 are formed by a lengthwise extending strip 18, as described above, extending parallel to and spaced inwardly from the strip 18 forming sub-compartment 22. The lower portion 28 of the strip 18 forming the sub-compartments 24 and 26 has a reduced width for a purpose described below. A quantity of a first reactive component 30 of a two component gas generating system, such as a 50% citric acid solution, is contained in the first sub-compartment 22. A tablet 32 comprising the second reactive component of the two component gas generating system, such as concentrated sodium bicarbonate, is contained in the second sub-compartment 24. A water solution 34 of sodium bicarbonate, the second reactive component, is contained in the third sub-compartment 26 in an amount sufficient to provide all of the sodium bicarbonate needed to expand fully the expandable pouch means 2. The other compartments 16 each contain a quantity of the first reactive component 30. It is understood that the location of the two reactive components can be reversed and they can be in liquid or solid forms so long as they can be combined.

In operation, a force is applied to the first sub-compartment 22 to rupture the lengthwise extending strip 18 between the first and second sub-compartments 22 and 24 so that the citric acid solution 30 flows into sub-compartment 24 to contact the second reactive component, comprising the sodium bicarbonate tablet 32, and begins to react therewith to generate carbon dioxide gas. This reaction with the tablet 32 proceeds at a rate to provide the above-described delaying system to allow the expandable pouch means 2 to be inserted into the container and suitable sealing and dispensing means applied to the container means. The generation of the carbon dioxide gas forms a pressurized force forcing the strip 18 between the second sub-compartment 24 and the third sub-compartment 26 to rupture at the weakened reduced width 28 to combine the second and third sub-compartments 24 and 26. This permits the citric acid solution 30 to flow into the third sub-compartment 26 and into contact with the water solution 34 of sodium bicarbonate and further react to continue the generation of carbon dioxide gas. As the generation of the carbon dioxide gas continues, the pressure within the completely formed first compartment 14 is increased so as to expand the portions of the flat sheets 4 and 6 forming the first compartment 14, as illustrated in FIG. 3. The dispensing of fluid from the container means, as described below, will provide space for further expansion of the expandable pouch means 2. When the limit of the volume of the first compartment 14 is reached, further generation of carbon dioxide gas therein will result in a force being applied to the strip 18 between the first compartment 14 and the next adjacent other compartment 16 so as to rupture such strip 18. The citric acid solution 24 in the next adjacent other compartment 16 will contact the water solution 34 of sodium bicarbonate to continue the generation of carbon dioxide gas. This sequence will continue until the expandable pouch means 2 has been substantially completely expanded.

Figure 4:
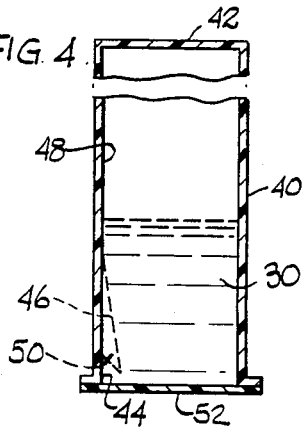
FIG. 4 is a cross-sectional view of a container for holding one component of a gas generating system.

Another embodiment for the provision of the citric acid solution 30 in the first compartment 14 is illustrated in FIG. 4 and is particularly useful when the fluid in the container means is a carbonated beverage, such as beer. A substantially rigid container 40, which in the preferred embodiment is plastic, has a closed end 42 and an open end 44. The container 40 is illustrated as being a tube but it is to be understood that it can be of any desired geometrical configuration. A barb 46 is secured to the inner surface 48 of the container 40 with its pointed end 50 facing and relatively close to the open end 44. A quantity of the citric acid solution 30 is placed in the container 40 and the open end 44 is sealed by a flexible membrane 52. The strips 18 forming the sub-compartments 22, 24 and 26 are not used in this modification so that the first compartment 14 is one unitary compartment. The filled container 40 is contained in the first compartment 14 with the water solution 34 of sodium bicarbonate. After the expandable pouch means 2 has been inserted into the container filled with a carbonated beverage, as described below, the pressures generated by the carbonated beverage in the container means will exert a pressure on the flexible membrane 52 moving it into contact with the pointed end 50 to rupture the flexible membrane 52 and permit the citric acid solution 30 to flow into the water solution 34 of sodium bicarbonate in first compartment 14 to start the carbon dioxide gas generating system.

Figure 5:
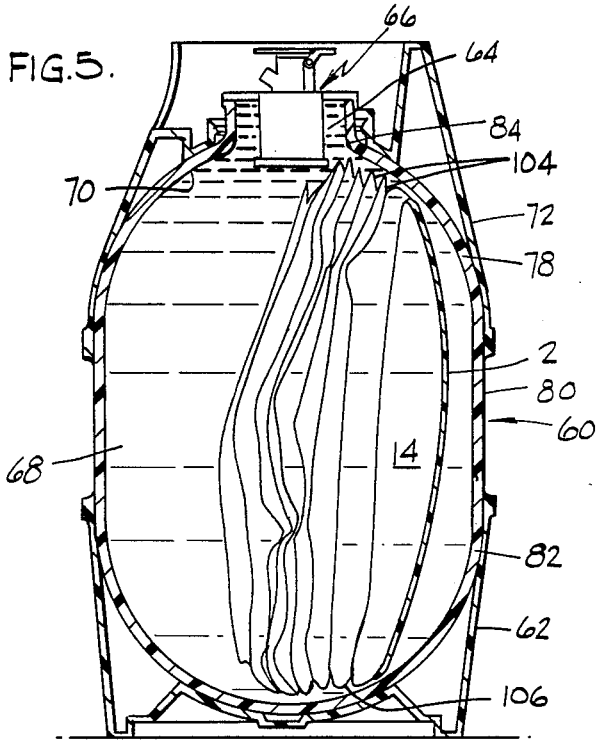
FIG. 5 is a cross-sectional view, except for the dispensing means, illustrating a container means and its supporting structure in an upright position for shipping and commercial storage and a partially expanded expandable pouch means.
Figure 6:
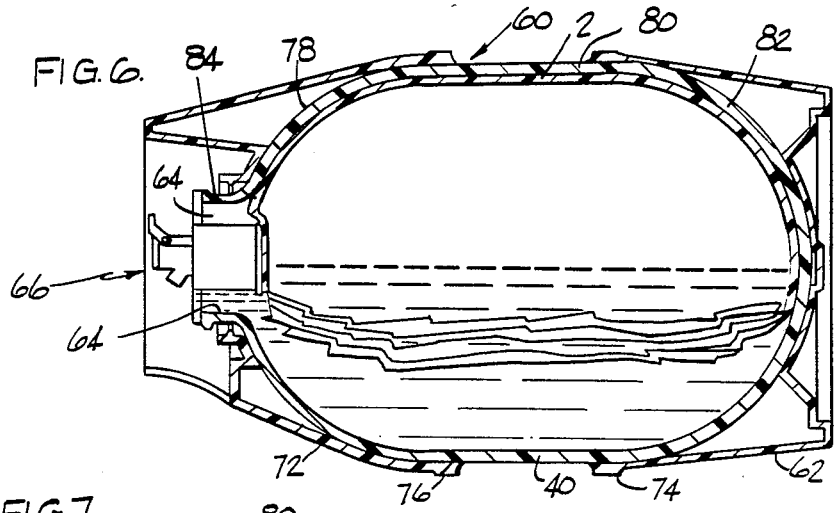
FIG. 6 is a view similar to FIG. 5 but with the container means in a dispensing position and after more than half of the fluid has been dispensed.
Figure 7:
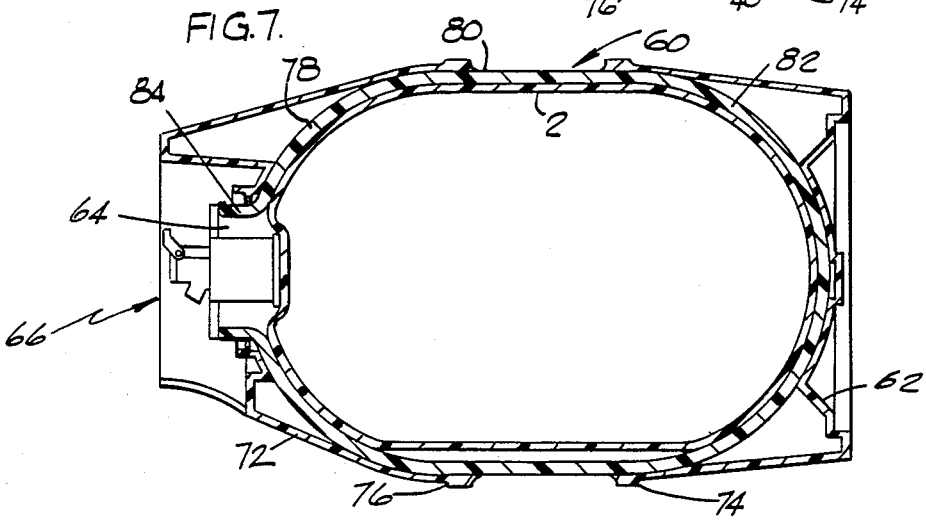
FIG. 7 is a view similar to FIG. 6 but after substantially all of the fluid has been dispensed.

The location of the expandable pouch means 2 in a container means 60 for holding a fluid is illustrated in FIGS. 5–7. In FIG. 5, the container means 60 is supported in the upright position for shipping and commercial storage by a support member 62. The expandable pouch means 2 has a length substantially greater than the longitudinal extent of the container means 60 and a width substantially greater than the diameter of the container means 60. Therefore, in order to insert the expandable pouch means 2 through an opening 64 in the container means 60, it is necessary to apply a force in a widthwise direction to compact the expandable pouch means 2 in that direction so that its cross-sectional configuration is less than the cross-sectional configuration of the opening 64. Also, as the expandable pouch means 2 is inserted into the container means 60, it is necessary to apply a force in the lengthwise direction to push the expandable pouch means 2 into the container means 60. This results in a crumpling of the expandable pouch means 2 in the lengthwise direction. Since the material in the expandable pouch means 2 has little tendency to resile, it will remain crumpled while a dispensing means 66 for dispensing portions of the material in the container means 60 is assembled in the opening 64 and forms a seal for the opening 64 so that fluid may be removed from the container means 60 only through the dispensing means 66. In the preferred embodiment, the fluid 68, such as a carbonated beverage such as beer, is in the container means 60 prior to the insertion of the expandable pouch means 2. If desired, the expandable pouch means 2 can be inserted into the container means 60 prior to the filling of it with the fluid. The fluid level 70 is slightly below the dispensing means 66. The lengthwise extending strip 18 between the first and second sub-compartments 22 and 24 is ruptured prior to the insertion of the expandable pouch means 2 into the container means 60 so that the gas generating system is in operation, as described above, and the first compartment 14 has been at least partially expanded as illustrated in FIG. 5. The container means 60 is illustrated in the fluid dispensable position in FIGS. 6 and 7. Another support member 72 has been previously secured to the container means 60. The support member 62 and the support member 72 have planar surfaces 74 and 76 for supporting the container means 60 on a generally horizontal surface, such as a shelf of a home refrigerator. The planar surfaces 74 and 76 also function to maintain the container means 60 in such fluid dispensable position. While it is highly preferred to use the horizontal dispensing position, it is understood that the pressure in the container means provided by the expandable pouch means would permit dispensing in other positions, some of which may require different types of dispensing means. In FIG. 6, more than half of the fluid has been dispensed from the container means 60. The first compartment 14 and several of the next adjacent other compartments 16 have been expanded, as described above, to form a combined compartment which is located adjacent to the upper longitudinally extending portion of the container means 60. In FIG. 7, the expandable pouch means 2 is substantially fully expanded and is substantially completely in contact with the inner surface of the container means 60 except for the portion defining the opening 64. After substantially all the fluid 68 has been dispensed from the container means 60, a pressure relieving device (not shown) in the dispensing means 66 is actuated and the carbon dioxide gas in the expanded pouch means 2 is removed through the dispensing means 46 so that the container means 60 and the expandable pouch means 2 are substantially at atmospheric pressure and the container means 60 can be safely placed in the trash.

When the expandable pouch means 2 is being inserted into the container means 60, the strips 18 are generally parallel with the longitudinal axis of container means 60. As explained above, the relative length of the expandable pouch means 2 causes it to be crumpled as it is inserted into the container means 60. However, the strips 18 still extend generally in the same direction as the longitudinal axis of the container means 60. As fluid is dispensed from the container means 60 and more of the other compartments 16 are expanded, the expanded portion of the expandable pouch means 2 gradually moves into a position wherein its longitudinal axis is parallel to the longitudinal axis of the container means 60, as illustrated in FIG. 6. When the expandable pouch means 2 is fully expanded, as illustrated in FIG. 7, the longitudinal axes of the expandable pouch means 2 and the container means 60 will substantially coincide.

As illustrated in FIGS. 5–7, the container means 60 comprises a blown hollow integral plastic body made of one piece of integrally molded plastic material, such as polyethylene terephthalate (PET), and having a hemispherical top portion 78, an annular cylindrical central portion 80, a hemispherical bottom portion 82 and a neck portion 84 defining the opening 64. The container means 60 is large enough to hold 288 fluid ounces of a beverage while providing space for the expandable pouch means 2.

The expandable pouch means 2 may be of any size and shape so as to be commensurate with the size and shape of the container means 60 with which it is to be used. Also, the expandable pouch means 2 may be used to dispense any kind of material from a container as is customary in this art. However, in the preferred embodiment of the invention, the expandable pouch means 2 has an unique configuration for cooperation with the container 60 to ensure that the pressure on the liquid in the container 60 is maintained within the desired narrow ranges of pressure and that substantially all of the liquid is dispensed from the container. The container means 60 has an overall length along its longitudinal axis of about 15.5 inches, an external diameter of the cylindrical central portion 70 of about 9.0 inches, an average wall thickness of about 0.030 inches and wherein it is desired to maintain a pressure profile within the container means between 18 and 25 psig. The expandable pouch means 2 has a overall length of about 17 inches and an overall width of about 15.5 inches and has nine compartments formed therein.

The following table lists the various design parameters involved in dispensing a beverage from a container wherein the container has an overflow volume of about 10.2 liters and contains 8.52 liters of beer at a temperature of about 38° F. and at a pressure equal to that at an altitude of about 5,000 feet. In the table the head space volume is listed as 1.220799 liters. This is the volume to which the first compartment 14 will expand to before any beer is dispensed from the container. The first compartment will expand to a volume of 1.565575 liters before the peelable seam strip 18 between it and the next adjacent other compartment is ruptured. The first compartment 14 or sub-compartment 26 will contain 100 grams of sodium bicarbonate, which is more than the stoichiometric amount necessary to react with the citric acid to produce the required pressurizing gas, combined with 170 ml of water and any other desired additional ingredients.

Setup conditions:

| | |
|---|---|
| Product Volume to be dispensed (L) | 8.520001 |
| Product Overage Volume (L) | 0.0592 |
| Absolute Pressure (PSIA) | 12 |
| Starting Gauge Pressure (PSIG) | 25 |
| Low Limit Operating Pressure (PSIG) | 18 |
| High Limit Operating Pressure (PSIG) | 25 |
| Starting Process Temperature (F) | 38 |
| Pouch/Chemical Total Displacement Vol (L) | 0.35 |
| Tap Displacement Volume (L) | 0.05 |
| Container Overflow Volume (L) | 10.2 |
| Head Space Liquid Volume (L) | 0.17 |

The following are pouch design parameters based on the above setup conditions:

| | |
|---|---|
| Head Space Volume (L) | 1.220799 |
| Total Charging Gas (Moles) | 0.164039 |
| Acid Required to charge to Start Press.(GMS) | 10.49849 |
| 50% Conc. Acid required for Start Press.(ML) | 16.93305 |
| Theoretical sodium bicarbonate required (gms) | 75.76741 |
| Actual sodium bicarbonate included (gms) | 100.000 |
| Sodium bicarbonate in tablet (gms) | 1.00 |

Emptied Container Conditions:

| Comp Num. | Comp Vol. (L) | Incr. Disp (L) | Tot. Disp (L) | Incr. Acid (ML) | Incr. Acid (GM) | Diff. Gas (Mo) |
|---|---|---|---|---|---|---|
| 1 | 1.565575 | .3447768 | .3447768 | 4.020651 | 2.492804 | 3.895007E-02 |
| 2 | 1.992217 | .4266421 | .7714188 | 4.975334 | 3.084707 | 4.819854E-02 |
| 3 | 2.520163 | .5279455 | 1.299364 | 6.156694 | 3.81715 | 5.964297E-02 |
| 4 | 3.173466 | .653303 | 1.952667 | 7.618569 | 4.723513 | 7.380486E-02 |
| 5 | 3.981892 | .8084259 | 2.761093 | 9.427541 | 5.845076 | 9.132937E-02 |
| 6 | 4.982274 | 1.000382 | 3.761476 | 11.66607 | 7.232964 | .113015 |
| 7 | 6.229191 | 1.237917 | 4.999393 | 14.43609 | 8.950374 | .1398497 |
| 8 | 7.752043 | 1.531852 | 6.531245 | 17.86387 | 11.0756 | .1730562 |

| Comp Num. | Comp Vol. (L) | Incr. Disp (L) | Tot. Disp (L) | Tot. Remn (L) | Tot. Gas (Mo) | Tot. Acid (GM) | Final Press (PSI) |
|---|---|---|---|---|---|---|---|
| 9 | 9.740799 | 1.988756 | 8.520001 | .0592 | .9018856 | 57.72068 | 17.72359 |

The pouch seam locations below are measured between the inside edge of the first permanent seam and the trailing edge of each peelable compartment seam and the outside edge of the opposite permanent seam:

| Comp No. | Comp Vol (L) | Seam at (inches) |
|---|---|---|
| 1 | 1.565575 | 5.404052 |
| 2 | 1.992217 | 6.073413 |
| 3 | 2.520163 | 6.873369 |
| 4 | 3.173466 | 7.779452 |
| 5 | 3.981892 | 7.734003 |
| 6 | 4.982274 | 9.794613 |
| 7 | 6.220191 | 10.90686 |
| 8 | 7.752043 | 12.25709 |
| Final | 9.740799 | 15 |

Figure 8:
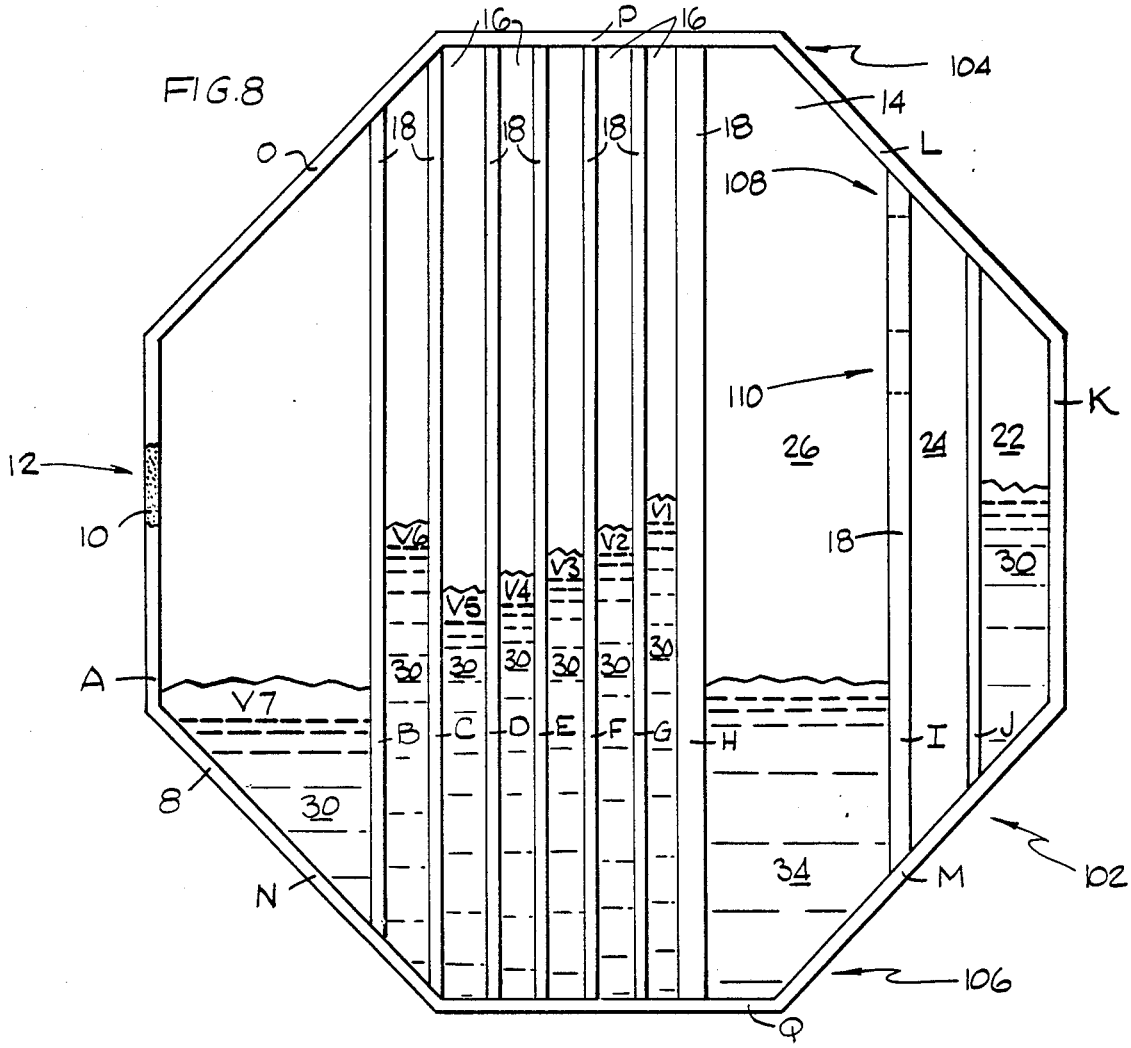
FIG. 8 is a view similar to FIG. 1 and illustrating the preferred embodiment of the expandable pouch means.

The preferred embodiment of the invention is illustrated in FIG. 8. Many parts of the expandable pouch means 102 for applying pressures on a fluid in a container are the same as corresponding parts of the expandable pouch means 2 so that the same reference numerals have been applied thereto and no further description thereof is made. In this embodiment of the invention, the composite material for the expandable pouch means 102 comprises an outside layer of a polyester such as PET with an inside coating of PVDC and a primer adhesive on the PVDC laminated with low density polyethylene to a co-extruded layer containing ethylene vinyl alcohol, polyethylene, and an ionomer resin, such as that marketed by Dupont under the trade designation SURLYN ®. The peripheral edge portions 8 and 10 of this preferred embodiment are permanently joined together by a permanent sealing means 12 formed by heat sealing at a temperature of about 300° F. for about 2.75 seconds and at a jaw pressure of about 35 psig. The permanent sealing means 12 of this embodiment have a width of about 0.25 inch as compared to the width of about 0.50 inch of the expandable pouch means 2. The lengthwise extending strips 18 of this preferred embodiment comprise semi-permanent peelable sealing means formed by heat sealing at a temperature of about 190–220° F. for a period of about 2.75 seconds and at a jaw pressure of about 35 psig. As the expandable pouch means 130 are inserted into the container 60, as illustrated in FIG. 5, the lengthwise extending strips 18 of semi-permanent peelable sealing means 20 have top ends, indicated generally by the reference numeral 104, and bottom ends, indicated by the reference numeral 106. The lengthwise extending strip 18 of semi-permanent peelable sealing means 20 between the third sub-compartment 26 and the second sub-compartment 24 has a first opening 108 formed therein spaced from its juncture with the permanent joined peripheral edge portions 8 and 10. Also, a second opening 110 is located a short distance below the first opening 108 and each of the openings 108 and 110 provide fluid communication between the third sub-compartment 26 and the second sub-compartment 24. As described above, a quantity of the first reactive component 30, such as a 50% citric acid solution, is contained in first sub-compartment 22. Also, a quantity of the second reactive component comprising a precipitated sodium bicarbonate in a water-dispersable suspension medium such as a gum or an algin in an amount sufficient to carry out the complete expanding operation is contained in the third sub-compartment 26. The second sub-compartment 24 contains neither component. The approximate level of the liquid in the various compartments when the expandable pouch means 102 is in the vertical position is illustrated in FIG. 8 In the embodiments of the invention illustrated in FIGS. 8–10, it is not necessary that the expandable pouch means 102 have a length greater than its width, and it can be of other shapes than the octagonal shape illustrated therein.

The expandable pouch means is formed by cutting the composite material to form a plurality of the octagonally shaped layers illustrated in FIG. 8. Two layers are superposed and subjected to heat as described above to form all of the lengthwise extending strips of the semi-permanent peelable sealing means and to permanently seal the bottom and side peripheral edge portions A, N, Q, M and K. The expandable pouch 130 is held in a vertical position and the desired amount of the first or second reactive component is deposited in each of the various compartments and sub-compartments. The top peripheral edge portions O, P and L are then permanently sealed.

Figure 9:
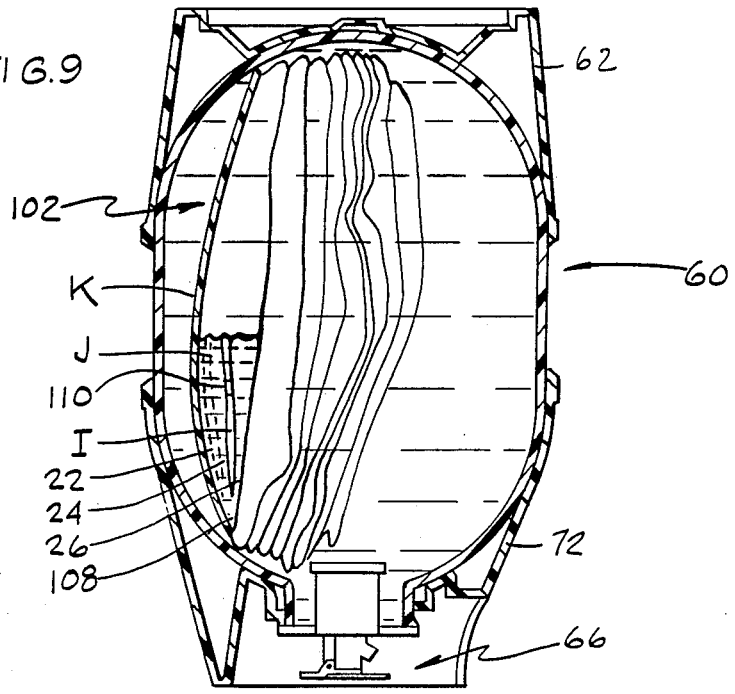
FIG. 9 illustrates a filled and sealed container means immediately after it has been moved to an inverted position.

In operation, the expandable pouch means 102 are held in a vertical position so that the first reactive component 30 in the first sub-compartment 22 is located in the lower portion thereof by suitable means (not shown). The lengthwise extending strip 18 of semi-permanent peelable sealing means 20 between the first and second sub-compartments 22 and 24 is mechanically ruptured by suitable means (not shown). It is not necessary that the entire strip 18 be ruptured but is preferably ruptured at least near the bottom end 106 to ensure that a sufficient amount of the acid solution 30 flows into the sub-compartment 24. This could be accomplished by using a pair of opposed pressure applying rollers moving over sub-compartment 22 beginning at the top end 104 and moving toward the bottom end 106. The expandable pouch means 102 are maintained in the vertical position and inserted into the container 60 and pushed down as described above. The dispensing means 66 are then inserted into the opening 64 and secured thereto to form a seal for the opening 64 so that fluid may be removed from the container means 60 only through the dispensing means 64. The container means 60 is then inverted by suitable means (not shown) as illustrated in FIG. 9 so that the expandable pouch means 102 is also inverted. The first reactive component 30, the acid solution, has moved to the other end of the second sub-compartment 24 and the water suspension 34 of sodium bicarbonate, the second reactive component, has moved to the other end of the third sub-compartment 26 so that they are in fluid communication through the openings 108 and 110 so that the chemical reaction can commence to start the generation of the pressurizing carbon dioxide gas. The container means 60 remains in the inverted position for a period of time of about 2.00 minutes and is then returned to the upright position for shipment and storage. The compartment 14 expands an amount sufficient to exert pressures of about 26 psig on the fluid in the container means 60 when the fluid is beer.

The following various parameters are involved in dispensing beer from a container wherein the container has an overflow volume of about 10.2 liters and contains about 8.52 liters of beer at a temperature of about 38° F. and at a pressure equal to that at an altitude of about 5,000 feet. The head space volume is about 1.22 liters which is the volume to which the first compartment 14 will expand to before any beer is dispensed from the container. The first compartment will expand to a volume of about 1.56 liters before the peelable seam strip 18 between it and the next adjacent other compartment begins to rupture. The first compartment 14 or sub-compartment 26 will contain 100 grams of precipitated sodium bicarbonate, which is more than the stoichiometric amount necessary to react with the citric acid to produce the required pressurizing gas, in 170 ml of a water-dispersable suspension medium such as gum or algin and any other desired additional ingredients. The following information relates to other parameters associated with the expandable pouch means 102 of this embodiment.

In the following table, the dimensions are measured from the inside edge of permanent seam K to the left-hand edge of each strip or seam A–J . The outside length of each peripheral edge portion A and K is about 6.5 inches; of each peripheral edge portion L, M, N and 0 about 7.5 inches and of each peripheral edge portion P and Q about 6.0 inches. The distance between the outer edges of peripheral edge portions P and Q is about 17.0 inches and the distance between the outer edges of peripheral edge portions A and K is about 16.1875 inches. The width of each peripheral edge portion A and K–Q are about 0.25 inch; the width of strip I is about 0.375 inch; the width of strip H is about 0.50 inch and the width of each of the strips B–G and J is about 0.25 inch. The length of the opening 108 is about 0.75 inch and the length of the opening 110 is about 1.00 inch. Also, the table lists the amount of citric acid 30 in the various compartments and the amount of the water suspension of sodium bicarbonate 34 in compartment 26.

| Distance from K (inches) | | Compartment | Volume (ml) |
|---|---|---|---|
| J | 1.4380 | 22 | 17 |
| I | 2.8125 | 24 | 0 |
| H | 6.5630 | 26 | 210 |
| F | 8.1875 | V1 | 5.7 |
| E | 9.0620 | V2 | 6.6 |
| D | 9.9375 | V3 | 7.8 |
| C | 10.9375 | V4 | 8.0 |
| B | 11.9375 | V5 | 9.7 |
| A | 15.9375 | V6 | 11.9 |
| | | V7 | 14.4 |

It is understood that the foregoing parameters are only for an expandable pouch means 102 for use with the container 60 having the above-stated dimensions and that expandable pouch means 102 for other containers will be sized and shaped to be comparable with the containers in which they are to be inserted.

Figure 10:
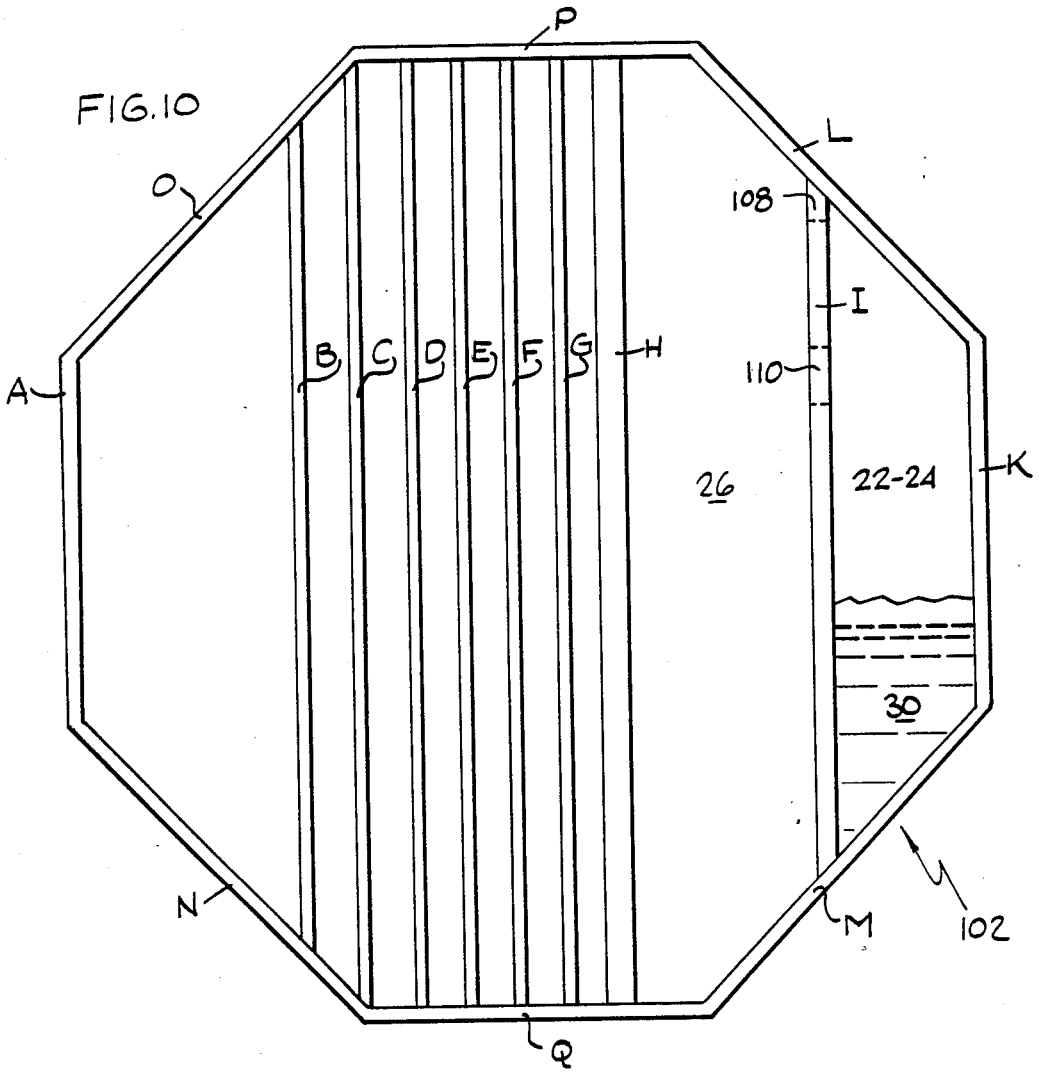
FIG. 10 is a view similar to FIG. 8 but illustrating another embodiment of the expandable pouch means.

Another embodiment of the invention is illustrated in FIG. 10 which is similar to the embodiment illustrated in FIG. 8, except that the strip 18 or seam J between sub-compartments 22 and 24 has been omitted so that sub-compartments 22–24 are now one sub-compartment. When using an expandable pouch means of this embodiment, it is necessary to keep the expandable pouch means in a vertical position from the time that the compartments and sub-compartments are filled and the peripheral edge portions Q, P and L sealed until the expandable pouch means has been inserted into a container and the container is sealed as described above. After that, the container is inverted to activate the two component gas generating system as described above.

Another system for generating the pressurizing gas comprises the first reactive component 30 in combined sub-compartments 22 and 24 in liquid or solid form and the second reactive component 34 in the opposite liquid or solid form in sub-compartment 26 or all in liquid form. The amount of the reactive component in one of the sub-compartments will be in an excessive quantity but not enough to fully expand the expandable pouch means. Thereafter, the reactive components in next succeeding compartments would alternate. For example, using each reactive component in liquid form, the volume of the first reactive component in combined sub-compartments 22 and 24 would be less than the volume of the second reactive component in sub-compartment 26. V 1, 3, 5 and 7 would then contain the first reactive component and V 2, 4 and 6 would contain the second reactive component in amounts sufficient to expand fully the expandable pouch means.

While the presently preferred embodiment and other illustrative embodiments of the invention have been described in detail herein, it is to be understood that the inventive concepts may be otherwise variously embodied and employed and that the appended claims are intended to be construed to include such variations except insofar as limited by the prior art.

What is claimed is:

1. A self-generating pressure applying means which is inserted into a container means having material contained therein so as to apply a pressure on the material so that it may be readily dispensed from the container means comprising:

an expandable pouch means for applying pressure to material in a container comprising at least two relatively flat sheets of a gas and liquid impermeable material in superposed relationship and having a length and a width with said length having a greater linear extent than said width;

said expandable pouch means having a plurality of linearly extending edge portions;

permanent sealing means for joining said superposed flat sheets along said edge portions so as to form an enclosed space therebetween;

compartment forming means between said superposed flat sheets for forming at least three compartments in said expandable pouch means;

said compartment forming means comprising lengthwise extending strips, having end portions joining said sealed edge portions, of a semi-permanent peelable sealing means for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in one of said compartments to increase the gas pressure in said one compartment so that, as portions of the material are dispensed from said container, portions of said superposed flat sheets forming said one compartment are forced apart to apply pressure to said semi-permanent peelable sealing means between said one compartment and a first next adjacent compartment so that said one compartment and said first next adjacent compartment are joined together to form a combined compartment;

at least a second next adjacent compartment;

gas pressure generating means in said first next adjacent compartment cooperating with said gas pressure generating means in said one compartment to continue the generation of gas pressure to force apart the portions of said superposed sheets forming said combined compartment as said material is dispensed from said container means to apply pressure to separate said semi-permanent peelable sealing means between said combined compartment and said at least a second next adjacent compartment so that said combined compartment and said at least a second next adjacent compartment are joined together to form a larger combined compartment;

said gas pressure generating means in said one compartment comprising first and second reactive components of a chemical gas generating system;

said gas pressure generating means in all of the other compartments comprises said first of said two reactive components;

said expandable pouch means being located within a container having a gas pressure generating beverage container therein;

said first reactive component of said two component chemical gas generating system in said one compartment comprises a liquid;

wherein said gas pressure generating means in said one compartment comprises:

at least said first reactive component being confined within an enclosure having rupturable means so that said enclosure may be ruptured allowing said first reactive component to react with said second reactive component to commence generating a gas;

said enclosure comprising a rigid container having at least one open end located in said first compartment;

a flexible membrane covering said open end and in sealed engagement therewith so as to contain a quantity of said first reactive component in said container;

membrane rupturing means in said container and located next to said open end so as to pierce said flexible membrane when said flexible membrane is forced into said container by pressure forces generated within said container so as to release said liquid first component into said first compartment.

2. A self-generating pressure applying means as in claim 1 and further comprising:

said container having an inner surface; and said membrane rupturing means comprises a pointed barb secured to said inner surface with the point of said pointed barb facing said flexible membrane.

3. A self-generating pressure applying means which is inserted into a container means having material contained therein so as to apply a pressure on the material so that it may be readily dispensed from the container means comprising:

an expandable pouch means for applying pressure to material in a container comprising at least two relatively flat sheets of a gas and liquid impermeable material in superposed relationship and having a length and a width said length having a greater linear extent than said width;

said expandable pouch means having a plurality of linearly extending edge portions;

permanent sealing means for joining said superposed flat sheets along said edge portions so as to form an enclosed space therebetween;

compartment forming means between said superposed flat sheets for forming at least three compartments in said expandable pouch means;

said compartment forming means comprising lengthwise extending strips, having end portions joining said sealed edge portions, of a semi-permanent peelable sealing means for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in one of said compartments to increase the gas pressure in said one compartment so that, as portions of the material are dispensed from said container, portions of said superposed flat sheets forming said one compartment are forced apart to apply pressure to separate said semipermanent peelable sealing means between said one compartment and a first next adjacent compartment so that said one compartment and said first next adjacent compartment are joined together to form a combined compartment;

at least a second next adjacent compartment;

gas pressure generating means in said first next adjacent compartment cooperating with said gas pressure generating means in said one compartment to continue the generation of gas pressure to force apart the portions of said superposed sheets forming said combined compartment as said material is dispensed from said container means to apply pressure to separate said semi-permanent peelable sealing means between said combined compartment and said at least a second next adjacent compartment so that said combined compartment and said at least a second next adjacent compartment are joined together to form a larger combined compartment;

said gas pressure generating means in said one compartment comprising first and second reactive components of a chemical gas generating system;

said gas pressure generating means in all of the other compartments comprises said first of said two reactive components;

wherein said gas generating means in said one compartment comprises:

lengthwise extending strips of a semipermanent peelable sealing means for dividing said one first compartment into at least first, second and third completely enclosed sub-compartments;

said first reactive component of said chemical gas generating system contained within said first sub-compartment;

said second reactive component of said chemical gas generating system contained within said second sub-compartment next adjacent to said first sub-compartment so that when said lengthwise strip between said first and second sub-compartments is ruptured, said first and second reactive components will begin to react to produce a gas pressure therein; and a quantity of said second reactive component, in an amount sufficient to fully expand said expandable pouch means, in said third sub-compartment next adjacent to said second sub-compartment to react with unreacted portions of said first reactive component when said first and second reactive components in said combined first and second sub-compartments have reacted to produce sufficient gases to provide a pressure to rupture said lengthwise strip between said second and third sub-compartments to continue the generation of gas.

4. A self-generating pressure applying means as in claim 3 wherein:

said lengthwise strip between said second and third sub-compartments having a weakened portion to facilitate rupturing thereof.

5. A self-generating pressure applying means which is inserted into a container means having material contained therein so as to apply a pressure on the material so that it may be readily dispensed from the container means comprising:

an expandable pouch means for applying pressure to material in a container comprising at least two relatively flat sheets of a gas and liquid impermeable material in superposed relationship and having a length and a width with said length having a greater linear extent than said width;

said expandable pouch means having a plurality of linearly extending edge portions;

permanent sealing means for joining said superposed flat sheets along said edge portions so as to form an enclosed space therebetween;

compartment forming means between said superposed flat sheets for forming at least three compartments in said expandable pouch means;

said compartment forming means comprising lengthwise extending strips, having end portions joining said sealed edge portions, of a semi-permanent peelable sealing means for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in one of said compartments to increase the gas pressure in said one compartment so that, as portions of the material are dispensed from said container, portions of said superposed flat sheets forming said one compartment are forced apart to apply pressure to separate said semipermanent peelable sealing means between said one compartment and a first next adjacent compartment so that said one compartment and said first next adjacent compartment are joined together to form a combined compartment;

at least a second next adjacent compartment;

gas pressure generating means in said first next adjacent compartment cooperating with said gas pressure generating means in said one compartment to continue the generation of gas pressure to force apart the portions of said superposed sheets forming said combined compartment as said material is dispensed from said container means to apply pressure to separate said semi-permanent peelable sealing means between said combined compartment and said at least a second next adjacent compartment so that said combined compartment and said at least a second next adjacent compartment are joined together to form a larger combined compartment;

said gas pressure generating means in said one compartment comprising first and second reactive components of a chemical gas generating system;

said gas pressure generating means in all of the other compartments comprises said first of said two reactive components;

wherein said gas generating means in said one compartment, when said expandable pouch means is in a vertical position so as to have a top end and a bottom end, comprises:

lengthwise extending strips of a semi-permanent peelable sealing means for securing together superposed portions of said superposed flat sheets for dividing said first compartment into at least first, second and third sub-compartments wherein said third sub-compartment is larger than either of said first and second sub-compartments;

a quantity of said first reactive component in liquid form located in said first sub-compartment.

a quantity of said second reactive component in liquid form located in said third sub-compartment; and fluid permeable means between said second sub-compartment and said third sub-compartment and located closer to said top end than to said bottom end for permitting fluid flow therebetween so that when said lengthwise extending strip of semi-permanent peelable sealing means between said first and second sub-compartments is ruptured, said first reactive component will flow into said second sub-compartment and when said expandable pouch means is inverted, said first reactive component will be able to contact said second reactive component in said third sub-compartment and react therewith to generate said gas.

6. A self-generating pressure applying means as in claim 5 wherein said fluid permeable means comprises:

at least one opening in said lengthwise extending strip of semi-permanent peelable sealing means between said second sub-compartment and said third sub-compartment.

7. A self-generating pressure applying means as in claim 6 and further comprising:

said opening being located at the top end of said lengthwise extending strip of semi-permanent peelable sealing means between said second sub-compartment and said third sub-compartment next adjacent to a portion of said permanently sealed edge portion so that said expandable pouch means must be inverted to allow contact to be made between reactive components in said second sub-compartment and said third sub-compartment.

8. A self-pressurizing dispensing container means for liquids of the type having a container means, a liquid dispensing means mounted on the container means, a liquid within the container means and a self-generating pressure applying means within the container means for applying pressure on the liquid comprising:

a hollow plastic container means made of one piece of integrally molded plastic material for holding a liquid to be selectively dispensed therefrom when located in a dispensing position;

liquid dispensing means mounted on said container means for dispensing liquid from said container means;

said container means having an elongated central generally cylindrical wall portion, an integral generally hemispherical closed first end wall portion, and an integral generally hemispherical second end wall portion having a central longitudinally extending neck portion with a relatively large diameter central opening of sufficient size for filling said container means with a liquid and for inserting said pressure applying means and having means for securing said dispensing means thereto to provide a sealing relationship therewith and having a longitudinal axis extending through said central opening;

support means fixedly attached to said container means supporting and maintaining said container means in said dispensing position;

self-generating pressure applying means in said container means for applying pressure to said liquid in said container means comprising:

an expandable pouch means for applying said pressure comprising at least two relatively flat sheets of a gas and liquid impermeable material in superposed relationship and having a length and a width with said length having a greater linear extent than said width;

said expandable pouch means having a plurality of linearly extending edge portions;

permanent sealing means for joining said superposed flat sheets along said edge portions so as to form an enclosed space therebetween;

compartment forming means between said superposed flat sheets for forming at least three compartments in said expandable pouch means;

said compartment forming means comprising lengthwise extending strips, having end portions joining said sealed edge portions, of a semi-permanent peelable sealing means securing together superposed portions of said superposed flat sheets;

said semi-permanent peelable sealing means permitting separation of said superposed portions of said superposed flat sheets in response to pressure applied thereto;

gas pressure generating means in one of said compartments to increase the gas pressure in said one compartment so that the portions of said superposed flat sheets forming said one compartment are forced apart to apply pressure to separate said semi-permanent peelable sealing means between said one compartment and a first next adjacent compartment so that said one compartment and said first next adjacent compartment are joined together to form a combined compartment;

at least a second next adjacent compartment;

gas pressure generating means in said first next adjacent compartment cooperating with said gas pressure generating means in said one compartment to continue the generation of gas pressure to force apart the portions of said superposed sheets forming said combined compartment as said beverage is dispensed from said container means to apply pressure to separate said semi-permanent peelable sealing means between said combined compartment and said at least a second next adjacent compartment so that said combined compartment and said at least next adjacent second compartment are joined together to form a larger combined compartment;

said expandable pouch means being located within said container means so that said lengthwise extending strips of said semi-permanent peelable sealing means extend generally in the same direction as said longitudinal axis of said container means; and said one compartment and thereafter each of said combined compartments of said expandable pouch being located next adjacent to the upper longitudinally extending portion of said container means when in its dispensing position.

9. A self-generating pressure applying means as in claim 8 wherein said gas pressure generating means in said one compartment comprises:

a chemical gas generating system comprising at least two reactive components; and at least a first of said reactive components being confined within an enclosure having rupturable means so that said enclosure may be ruptured allowing said first reactive component to react with the second reactive component to commence generating a gas.

10. A self-generating pressure applying means as in claim 8 wherein said gas generating means in said one compartment comprises:

a chemical gas generating system comprising at least two reactive components;

lengthwise extending strips of a semi-permanent peelable sealing means for dividing said one compartment into at least first, second and third completely enclosed sub-compartments;

a first reactive component of said chemical gas generating system contained within said first sub-compartment;

a second reactive component of said chemical gas generating system contained within said second sub-compartment next adjacent to said first sub-compartment so that when said lengthwise strip between said first and second sub-compartments is ruptured, said first and second reactive components will begin to react to produce a gas pressure therein; and a quantity of said second reactive component, in an amount sufficient to fully expand said expandable pouch means, in said third sub-compartment next adjacent to said second sub-compartment to react with unreacted portions of said first reactive component when said first and second reactive components in said combined first and second sub-compartments have reacted to produce sufficient gases to provide a pressure to rupture said lengthwise strip between said second and third sub-compartments to continue the generation of gas.

11. A self-generating pressure applying means as in claim 10 wherein:

said lengthwise strip between said second and third sub-compartments having a weakened portion to facilitate rupturing thereof.

12. A self-generating pressure applying means as in claim 8 wherein said gas generating means in said one compartment, when said expandable pouch means is in a vertical position so as to have a top end and a bottom end, comprises:

a chemical gas generating system comprising at least two reactive components;

lengthwise extending strips of a semi-permanent peelable sealing means for securing together superposed portions of said superposed flat sheets for dividing said first compartment into at least first, second and third sub-compartments wherein said third sub-compartment is larger than either of said first and second sub-compartments;

a quantity of said first reactive component of said chemical gas generating system in liquid form located in said first sub-compartments;

a quantity of said second reactive component of said chemical gas generating system in liquid form located in said third sub-compartment; and fluid permeable means between said second sub-compartment and said third sub-compartment and located closer to said top end than to said bottom end for permitting fluid flow therebetween so that when said lengthwise extending strip of semi-permanent peelable sealing means between said first and second sub-compartments is ruptured, said first reactive component will flow into said second sub-compartment and when said expandable pouch means is inverted, said first reactive component will be able to contact said second reactive component in said third sub-compartment and react therewith to generate said gas.

13. A self-generating pressure applying means as in claim 12 wherein said fluid permeable means comprises:

at least one opening in said lengthwise extending strip of semi-permanent peelable sealing means between said other smaller sub-compartment and said larger sub-compartment.

14. A self-generating pressure applying means as in claim 13 and further comprising:

said opening being located at the top end of said lengthwise extending strip of semi-permanent peelable sealing means between said second sub-compartment and said third sub-compartment next adjacent to a portion of said permanently sealed edge portion so that said container means and said expandable pouch means must be inverted to allow contact to be made between reactive components in said second sub-compartment and said third sub-compartment.

15. A self-generating pressure applying means which is adapted to be inserted into a container means having material contained therein so as to apply a pressure on the material so that it may be readily dispensed from the container means comprising:

an expandable pouch means for applying pressure to material in a container comprising at least two relatively flat sheets of a gas and liquid impermeable material in superposed relationship;

said expandable pouch means being located in a vertical direction in said container means so as to have a top end and a bottom end;

said expandable pouch means having a plurality of edge portions;

permanent sealing means for joining said superposed flat sheets along said edge portions so as to form an enclosed space therebetween;

compartment forming means between said superposed flat sheets for forming at least one compartment and at least another compartment in said expandable pouch means;

said compartment forming means comprising at least one strip of a semi-permanent peelable sealing means, having end portions joining said permanently sealed edge portions, for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in one of said compartments to increase the gas pressure in said one compartment so that, as portions of the material are dispensed from said container, portions of said superposed flat sheets forming said one compartment are forced apart to apply pressure to the material in said container means and to separate said semi-permanent peelable sealing means between said one compartment and said another compartment so that said one compartment and said another compartment are joined together to form a combined compartment;

gas pressure generating means in said another compartment cooperating with said gas pressure generating means in said one compartment to continue the generation of gas pressure to force apart the portions of said superposed sheets forming said combined compartment as said material is dispensed from said container means so as to continue to apply pressure to said material in said container means;

said gas pressure generating means in said one compartment comprises:

a chemical gas generating system comprising at least two reactive components;

strips of a semi-permanent peelable sealing means for securing together superposed portions of said superposed flat sheets for dividing said one compartment into at least first, second and third sub-compartments;

a quantity of a first reactive component of said chemical gas generating system in liquid form located in said first sub-compartment;

a quantity of a second reactive component of said chemical gas generating system in liquid form located in said third sub-compartment; and fluid permeable means between said second sub-compartment and said third sub-compartment and located closer to said top end than to said bottom end of said expandable pouch means for permitting fluid flow therebetween so that when said strip of semi-permanent peelable sealing means between said first and second sub-compartments is ruptured, said first component will flow into said second sub-compartment and when said expandable pouch means is inverted, said first reactive component will be able to contact said second reactive component in said third sub-compartment and react therewith to generate said gas.

16. A self-generating pressure applying means as in claim 15 wherein said at least another compartment comprises:

a plurality of another compartments separated by said strips of semi-permanent peelable sealing means;

a quantity of said first reactive component in each of said plurality of another compartments to continue the generation of gas; and wherein said quantity of said second reactive component in said third sub-compartment is more than the required stoichiometric amount to react with the first reactive components in all of the another compartments so as to fully expand said expandable pouch means.

17. A self-generating pressure applying means as in claim 15 wherein said fluid permeable means comprises:

at least one opening in said lengthwise extending strip of semi-permanent peelable sealing means between said second sub-compartment and said third sub-compartment.

18. A self-generating pressure applying means as in claim 17 and further comprising:

said opening being located adjacent to the top end of said lengthwise extending strip of semi-permanent peelable sealing means between said second sub-compartment and said third sub-compartment next adjacent to a portion of said permanently sealed edge portion so that said expandable pouch means must be inverted to provide said fluid communication between said second sub-compartment and said third sub-compartment.

19. A self-generating pressure applying means which is adjusted to be inserted into a container means having material contained therein so as to apply a pressure on the material so that it may be readily dispensed from the container means comprising:

an expandable pouch means for applying pressure to material in a container comprising at least two relatively flat sheets of a gas and liquid impermeable material in superposed relationship;

said expandable pouch means being located in a vertical direction in said container means so as to have a top end and a bottom end;

said expandable pouch means having a plurality of edge portions;

permanent sealing means for joining said superposed flat sheets along said edge portions so as to form an enclosed space therebetween;

compartment forming means between said superposed flat sheets for forming at least one compartment and at least another compartment in said expandable pouch means;

said compartment forming means comprising at least one strip of a semi-permanent peelable sealing means, having end portions joining said permanently sealed edge portions, for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in said one of said compartments to increase the gas pressure in said one compartment so that, as portions of the material are dispensed from said container, portions of said superposed flat sheets forming said one compartment are forced apart to apply pressure to the material in said container means and to separate said semi-permanent peelable sealing means between said one compartment and said another compartment so that said one compartment and said another compartment are joined together to form a combined compartment;

gas pressure generating means in said another compartment cooperating with said gas pressure generating means in said one compartment to continue the generation of gas pressure to force apart the portions of said superposed sheets forming said combined compartment as said material is dispensed from said container means so as to continue to apply pressure to said material in said container means;

said gas pressure generating means in said one compartment comprises:

a chemical gas generating system comprising at least two reactive components;

strips of a semi-permanent peelable sealing means for securing together superposed portions of said superposed flat sheets for dividing said one compartment into at least a first and a second sub-compartments;

a quantity of a first reactive component of said chemical gas generating system in liquid form located in said first subcompartment;

a quantity of a second reactive component of said chemical gas generating system in liquid form located in said second sub-compartment; and fluid permeable means between said first sub-compartment and said second sub-compartment and located closer to said top end than to said bottom end of said expandable pouch means for permitting fluid flow therebetween so that, when said expandable pouch means is inverted, said first reactive component will be able to contact said second reactive component in said second sub-compartment and react therewith to generate said gas.

20. A self-generating pressure applying means as in claim 19 wherein said at least another compartment comprises:

a plurality of another compartments separated by said strips of semi-permanent peelable sealing means; and a quantity of said first reactive component in each of said plurality of another compartments to continue the generation of gas; and wherein said quantity of said second reactive component in said second sub-compartment is more than the required stoichiometric amount to react with the first reactive component in all of said another compartments so as to fully expand said expandable pouch means.

21. A self-generating pressure applying means as in claim 19 wherein said fluid permeable means comprises:

at least one opening in said lengthwise extending strip of semi-permanent peelable sealing means between said first sub-compartment and said second sub-compartment.

22. A self-generating pressure applying means as in claim 21 and further comprising:

said opening being located adjacent to the top end of said lengthwise extending strip of semi-permanent peelable sealing means between said first sub-compartment and said second sub-compartment next adjacent to a portion of said permanently sealed edge portion so that said expandable pouch means must be inverted to provide said fluid communication between said first sub-compartment and said second sub-compartment.

23. A self-generating pressure applying means which is adapted to be inserted into a container means having material contained therein so as to apply pressure on the material so that it may be readily dispensed from the container means comprising:

an expandable pouch means for applying pressure to material in a container comprising at least two relatively flat sheets of a gas and liquid impermeable material in superposed relationship;

said expandable pouch means being located in a vertical direction in said container means so as to have a top end and a bottom end;

said expandable pouch means having a plurality of edge portions;

permanent sealing means for joining said superposed flat sheets along said edge portions so as to form an enclosed space therebetween;

compartment forming means between said superposed flat sheets for forming at least one compartment and at least three other compartments in said expandable pouch means;

said compartment forming means comprising strips of a semi-permanent peelable sealing means, having end portions joining said permanently sealed edge portions, for securing together superposed portions of said superposed flat sheets so that all of said compartments are completely closed;

said semi-permanent peelable sealing means permitting separation of said superposed portions of said superposed flat sheets in response to pressure applied thereto;

gas pressure generating means in one of said compartments to increase the gas pressure in said one compartment so that, as portions of the material are dispensed from said container, portions of said superposed flat sheets forming said one compartment are forced apart to apply pressure to the material in said container means and to separate said semi-permanent peelable sealing means between said one compartment and said another compartment so that said one compartment and said another compartment are joined together to form a combined compartment;

gas pressure generating means in said other compartments cooperating with said gas pressure generating means in said one compartment to continue the generation of gas pressure to force apart the portions of said superposed sheets forming said combined compartment as said material is dispensed from said container means so as to continue to apply pressure to said material in said container means;

said gas pressure generating means in said one compartment comprises:

a chemical gas generating system comprising at least two reactive components;

strips of a semi-permanent peelable sealing means for securing together superposed portions of said superposed flat sheets for dividing said one compartment into at least a first and a second sub-compartments;

a quantity of a first reactive component of said chemical gas generating system in liquid form located in said first subcompartment;

a quantity of a second reactive component of said chemical gas generating system in liquid form located in said second sub-compartment; and fluid permeable means between said first sub-compartment and said second sub-compartment and located closer to said top end than to said bottom end for permitting fluid flow therebetween so that, when said expandable pouch means is inverted, said first reactive component will be able to contact said second reactive component in said second sub-compartment and react therewith to generate said gas; and wherein:

the first and third other compartments each having a quantity of said first reactive component contained therein in amount sufficient to continue the generation of gas; and the second other compartment having a quantity of said second reactive component contained therein in an amount sufficient to continue the generation of gas.

24. A method for applying pressure to a material in a container comprising:

holding a container so that at least one portion thereof extends generally in a vertical direction so as to have a top end and a bottom end;

flowing a quantity of a fluid material into said container through an opening in said top end thereof;

forming an expandable pouch from at least two relatively flat sheets of a gas and liquid impermeable material by placing said at least two relatively flat sheets in superposed relationship and permanently sealing together the edge portions thereof;

forming at least one enclosed compartment and at least another enclosed compartment in said expandable pouch by joining together superposed portions of said at least two relatively flat sheets with a strip of a semi-permanent peelable sealing means so that said superposed portions may be separated by internal pressures applied thereto;

dividing said at least one compartment into at least first, second and third sub-compartments using strips of a semi-permanent sealing means so that said first sub-compartment is completely enclosed;

forming at least one fluid permeable passageway between said second sub-compartment and said third sub-compartment;

holding said expandable pouch so that at least one portion thereof extends in a vertical direction so that said expandable pouch has a top end and a bottom end;

inserting a quantity of a first reactive component of a chemical gas generating system comprising at least two reactive components into said first sub-compartment and a quantity of the second reactive component into said third sub-compartment;

inserting a quantity of said first reactive component into said at least another compartment;

rupturing said linearly extending strip of semi-permanent peelable sealing means between said first and second sub-compartments so that at least a portion of said quantity of said first reactive component flows into said second sub-compartment;

inserting said expandable pouch into said container through said opening so that the vertical direction of said expandable pouch corresponds to the vertical direction of said container;

securing a dispensing means to said opening so that said fluid in said container can be removed only through said dispensing means;

manipulating said container so that said first reactive component in said second sub-compartment and said second reactive component in said third sub-compartment contact each other through said fluid permeable passageway and begin said chemical reaction to generate said gas to expand said one compartment to exert pressure on said fluid material in said container; and continuing said chemical reaction to generate said gas as said fluid material is dispensed from said container to apply pressure to said superposed sheets to separate said linearly extending strip of semipermanent peelable sealing means between said one compartment and said another compartment to continue the generation of said gas.

25. A method as in claim 24 and further comprising:

forming a plurality of another compartments separated by strips of semi-permanent peelable sealing means.

26. A method as in claim 24 wherein said manipulating of said container comprises:

inverting said container so that said first reactive component in said second sub-component and said second reactive component in said third sub-compartment move into contacting relationship through said fluid permeable passageway.

27. A method as in claim 26 and further comprising:

forming said fluid permeable passageway as an opening.

* * * * *